United States Patent [19]

Farlind

[11] 3,945,091

[45] Mar. 23, 1976

[54] BUCKLES FOR SAFETY BELTS

[75] Inventor: Stig Axel Goran Farlind, Monsteras, Sweden

[73] Assignee: STECE - AB Industrifjadrar, Monsteras, Sweden

[22] Filed: Aug. 22, 1974

[21] Appl. No.: 499,634

[30] Foreign Application Priority Data

Sept. 4, 1973 Sweden ..... 7312009

[52] U.S. Cl. ..... 24/230 A; 24/211 R

[51] Int. Cl.[2] ..... A44B 11/26

[58] Field of Search..... 24/230A, 230 AV, 230 AT, 24/205.17, 205.18, 205.19, 211 R

[56] References Cited

UNITED STATES PATENTS

| | | | |
|---|---|---|---|
| 3,029,487 | 4/1962 | Asai | 24/230 A |
| 3,639,951 | 2/1972 | Inoue et al. | 24/230 A |
| 3,846,876 | 11/1974 | Weman | 24/230 A |

FOREIGN PATENTS OR APPLICATIONS

| | | | |
|---|---|---|---|
| 1,151,229 | 5/1969 | United Kingdom | 24/230 AT |

*Primary Examiner*—Werner H. Schroeder
*Assistant Examiner*—Conrad L. Berman
*Attorney, Agent, or Firm*—Karl W. Flocks

[57] ABSTRACT

One part of a buckle for safety belts for use in vehicles is a locking tongue and the other part is a buckle body having a pocket-shaped opening for the insertion of the locking tongue thereinto. The locking tongue insertion opening or pocket is defined in the buckle body by two fixed side plates which are spaced apart a distance substantially equal to the thickness of the locking tongue, and by guides coacting with the two longitudinal edge portions of the locking tongue. The buckle body includes a spring-actuated latch serving as a locking means, the latch being mounted to one side plate and adapted, by spring action, to be kept in locking position in which it preferably bears against the other side plate, at least one shoulder of the latch being situated in the pocket for engagement with a corresponding shoulder of the locking tongue. With the aid of an operating means the latch can be moved with its shoulder, against spring action, out of the locking position in the pocket to be accommodated, together with the latch portions adjoining the shoulders, in a recess in the first side plate, thereby releasing the locking tongue. To this end, the latch is of such a configuration that in released position it will altogether be adjacent to that side of the locking tongue insertion pocket which is defined by the first side plate.

4 Claims, 12 Drawing Figures

27
15
28
30
26
31
25
34

1
14
14

5
7
7
32
32
33
33

26
24
6
V
22
18
17
9
9
9
9
23

V

BUCKLES FOR SAFETY BELTS

This invention relates to a buckle for safety belts for use in vehicles, preferably automobiles, aircrafts, seacraft. One part of the buckle is a locking tongue and the other part is a buckle body having a pocket-shaped opening for the insertion of the locking tongue thereinto. Said pocket is defined in the buckle body by two fixed side plates which are spaced apart a distance substantially equal to the thickness of the locking tongue, and by guides coacting with the two longitudinal edge portions of the locking tongue. The buckle body includes a spring-actuated latch serving as a locking means, said latch being mounted to one side plate and adapted, by spring action, to be kept in locking position in which it preferably bears against the other side plate. At least one shoulder of the latch is situated in the pocket for engagement with a corresponding shoulder of the locking tongue. With the aid of an operating means the latch can be moved with its shoulder, against spring action, out of the locking position in the pocket to be accommodated, together with the latch portions adjoining the shoulders, in a recess in the first side plate, thereby releasing the locking tongue.

According to the invention, the latch is of such a configuration that in released position it will be adjacent to that side of the pocket which is defined by the first side plate. By this arrangement, the locking tongue can be varied within broad limits since it need not cooperate with any part of the latch in the released position.

An embodiment of the invention will be more fully described hereinbelow and with reference to the accompanying drawings in which:

FIG. 1A shows the rear portion of a casing accommodating the buckle body while FIG. 1B shows the front portion thereof; FIG. 1C shows the locking tongue; and FIG. 1D shows one side plate of the buckle body while FIG. 1E shows the other side plate thereof;

Figures 1A, 1B, 1C, 1D, 1E:
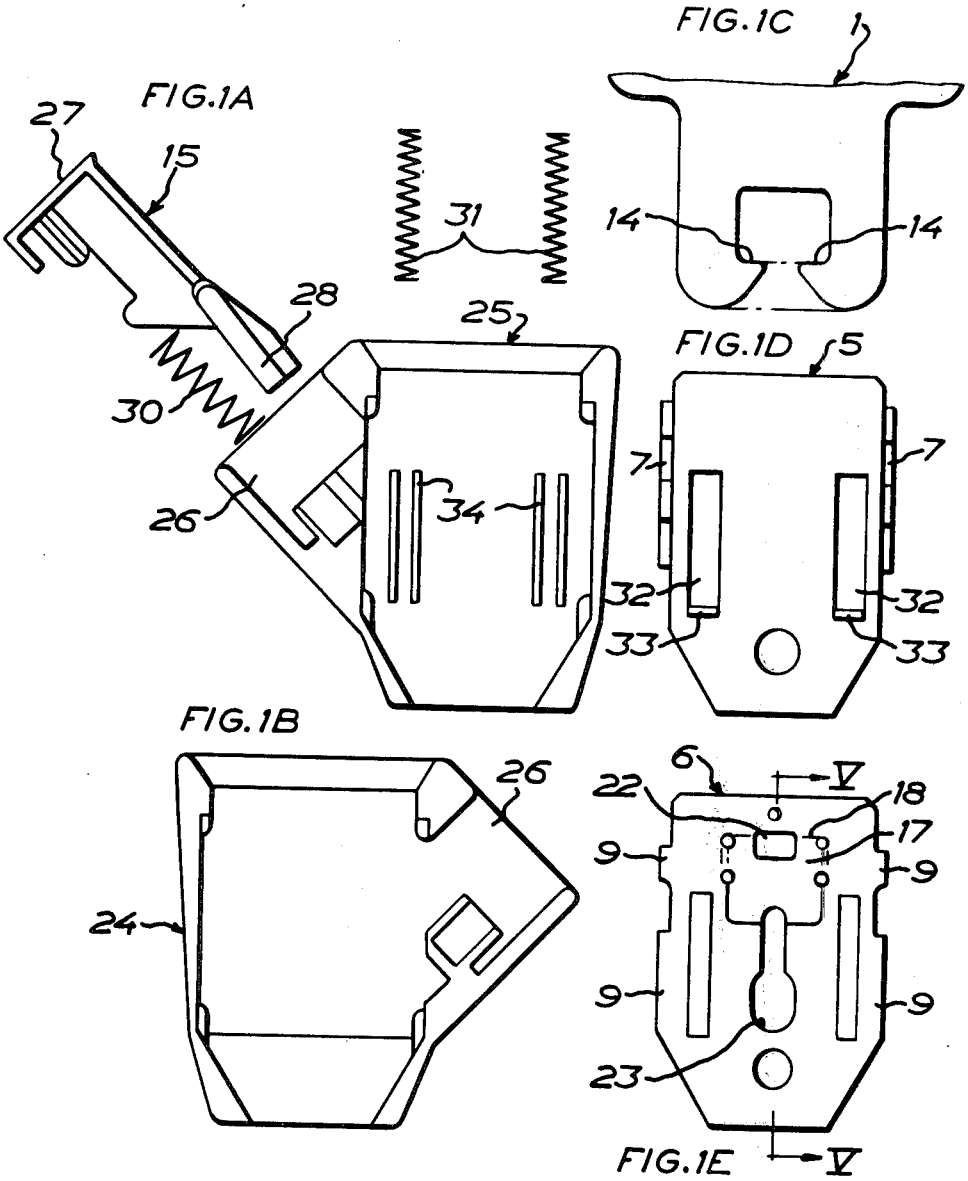
FIGS. 1A to 1E are side elevational views of all constituent parts of the buckle, except for the latch with its spring; more particularly
Figure 2:
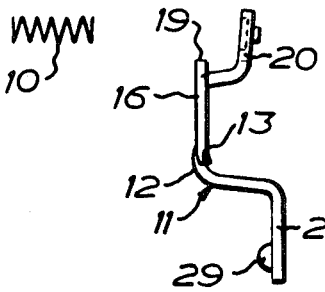
FIGS. 2 and 2A are side elevational views, at right angles to one another, of the latch with the spring thereof.
Figure 2A:
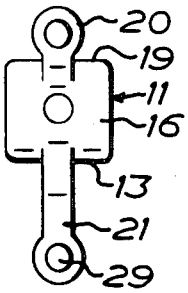
Figure 6:
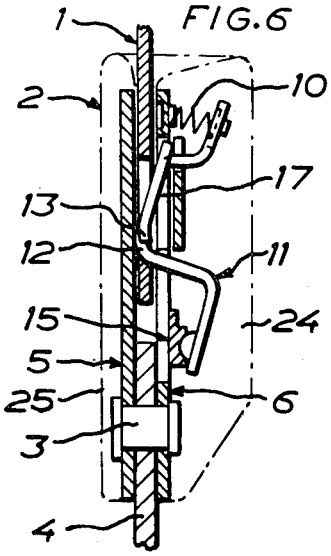
FIG. 6 is a longitudinal section of the buckle body with the locking tongue in locking position.

The buckle comprises the locking tongue 1 and the buckle body 2. The locking tongue 1 is adapted to be connected with one or more straps of the safety belt, while the buckle body 2 is adapted to be fixed to the floor or like part of the vehicle. As shown in the drawing, the buckle body 2 is secured by means of a rivet 3 to an anchorage 4. It is readily understood, however, that other fastenings can also be utilized.

The buckle body 2 has a pocket-shaped opening for the insertion of the locking tongue 1 thereinto. This opening or pocket is defined by two fixed side plates 5 and 6 or like means, which are spaced apart a distance substantially equal to the thickness of the locking tongue 1, and by guides coacting with the two longitudinal edge portions of the locking tongue 1. Said guides are formed by angularly bent edge portions 7 of the plate 5, and hook means 8 are provided on said edge portions 7 to engage corresponding projections 9 at the longitudinal edges of the plate 6.

The buckle body 2 incorporates a latch 11 which is under the load of a spring 10 and serves as a locking means. The latch 11 is mounted to the side plate 6 and kept in locking position by the spring 10, so that it bears with its portion 12 against the side plate 5. In locking position, one or more shoulders 13 formed on the latch 11 are situated in the locking tongue insertion pocket to engage corresponding shoulders 14 on the locking tongue 1. With the aid of the operating means 15, the latch 11 can be moved with its shoulder or shoulders 13, against the action of the spring 10, out of the locking position in the locking tongue insertion pocket to be accommodated, together with the latch portions adjoining the shoulder or shoulders 13, in a recess 17 in the side plate 6, thereby releasing the locking tongue 1. The latch 11 is of such a configuration that it will lie in released position entirely on that side of the locking tongue insertion pocket, which is defined by the side plate 6.

The recess 17 in the side plate 6 is formed by a substantially rectangular, pressed-out portion of the plate 6, the upper edge 18 of the recess 17 constituting the mounting for the latch 11 inasmuch as the latter and more particularly the upper edge 19 of the rectangular middle portion 16 of the latch pivotally bears against the upper edge 18. The lower edge of said middle portion 16 constitutes the shoulder or shoulders 13 of the latch.

An upper, outwardly bent end portion 20 and a lower, outwardly bent end portion 21 extend from the middle portion 16 of the latch 11. The side plate 6 is formed with through openings 22 and 23 for the outwardly bent end portions 20 and 21, said openings 22 and 23 being located at the upper and lower edges of the recess 17. The upper, outwardly bent end portion 20 of the latch 11 cooperates with the spring 10 of the latch. In the embodiment illustrated, the spring 10 is a compression coil spring which is interposed between the end portion 20 and the side plate 6. Both the upper end portion 20 and the plate 6 are provided with bosses, studs or like means for their engagement with the compression spring 10. The lower, outwardly bent end portion 21 of the latch 11 coacts with the operating means 15 to permit moving the latch 11 out of the locking position against the action of the spring 10.

The upper, outwardly bent end portion 20 of the latch 11 is adapted to bear against the lower edge of the opening 22 so that the latch 11 is prevented from moving downwardly in the insertion pocket when the locking tongue 1 is moved into locking position.

The buckle body, formed by the two plates 5 and 6, is disposed in a casing comprising a front portion 24 and a rear portion 25, said portions being provided with catches or like means for their interconnection. The casing is formed with a guide 26 for the operating means 15 which consists of a key 28 movably mounted between the side plate 6 and the lower, outwardly bent end portion 21 of the latch 11 and equipped with a push button 27. As shown in the drawing, the end portion 21 has a spherical boss or rivet 29 for its engagement with the key 28 of the operating means 15. The operating means 15 coacts with a return spring 30.

The embodiment illustrated of the opening means 15 can be varied within broad limits. With retained locking function of the buckle, the operating means 15 having the push button 27 can thus be placed in other angles or so as to extend in a straight upward direction, in which case the latch 11 can be equipped with abutment surfaces for two keys. The push button can also be placed on the flat sides of the buckle body, where the latch 11 can be directly or indirectly actuated by lever action of the push button. The essential thing is that the latch 11 is mounted in the side plate and that the lower, outwardly bent end portion 21 with key or lever can be moved away from the side plate 6 towards the portion 24 of the casing.

The portion 12 of the latch 11 is so arranged that in locking position the shoulder 13 will be situated midway between the two plates 5 and 6. To provide the largest possible abutment surface between the latch 11 and the locking tongue 1, the lower end of the portion 16 has been bent, as will appear from the drawing. Further, advantages are gained if the shoulders 14 of the locking tongue 1 are caused to form a single continuous shoulder, as shown by dash-and-dot lines in FIG. 1C.

According to the invention, the anchorage 4 constitutes a spacer between the two side plates 5 and 6, but it is readily understood that said plates can be given such a configuration that they serve as spacers themselves.

Figure 7:
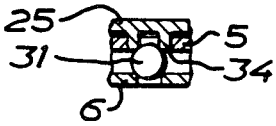
FIG. 7 is a cross section of a broken out portion of the buckle body taken at one of the slots of a plate.
Figure 3:
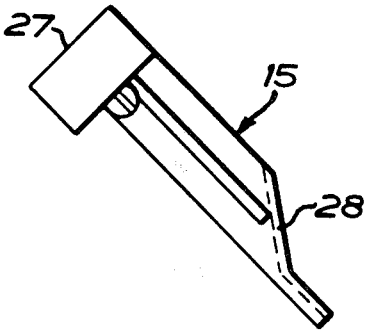
FIG. 3 is a side elevational view, taken at right angles to FIG. 1, of the operating means.
Figure 4:
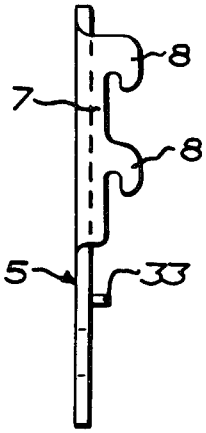
FIG. 4 is a side elevational view, likewise taken at right angles to FIG. 1, of the first side plate.
Figure 5:
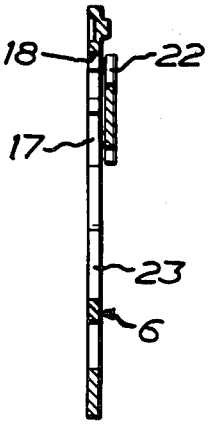
FIG. 5 is a section on the line V—V in FIG. 1E of the second side plate.

31 designates a pair of compression springs which tend to urge the locking tongue 1 out of the insertion pocket formed in the buckle body 2. The springs 31 are adapted to realize an even distribution of forces, as will appear from FIG. 7 which is a broken out portion of the buckle body taken at one of slots 32 of plate 5. The mounting of the compression springs 31 is carried out in the following manner. After the buckle body 2 proper has been mounted the compression springs 31 are passed into the slots 32. At the bottoms of these slots are provided abutments 33 which prevent the springs from taking an oblique position in the space between the side plates 5 and 6. The ribs 34 formed on the rear portion 25 of the casing will then move the compression springs 31 into a symmetrical position between the plates.

The invention is not restricted to the embodiment described and illustrated in the drawing, but can be modified within the spirit and scope of the appended claims.

What I claim and desire to secure by Letters Patent is:

1. A buckle for safety belts for use in vehicles, preferably automobiles, aircraft and seacraft, one part of the buckle being a locking tongue and the other part a buckle body having a pocket-shaped opening for the insertion of said locking tongue thereinto, said pocket being defined in said buckle body by two fixed side plates which are spaced apart a distance substantially equal to the thickness of said locking tongue and by guides connected to said side plates co-acting with two longitudinal edge portions of said locking tongue, said buckle body including a spring-actuated latch serving as a locking means, a spring and said latch being mounted to a first one of said side plates and adapted, by spring action, to be kept in locking position in which it preferably bears against the other of said side plates, at least one shoulder of said latch being situated in said locking tongue insertion pocket for engagement with a corresponding shoulder of said locking tongue, an operating means in said buckle body located for engagement with said latch, said latch with its said shoulder positioned for movement with the aid of said operating means, against spring action, out of the locking position in said pocket to be accommodated, together with latch portions adjoining said shoulders, in a recess in the first one of said side plates, thereby releasing said locking tongue, said recess in said first side plate formed by a pressed-out portion of said plate, the upper edge of said recess constituting a mounting for said latch in that said latch pivotally bears against said upper edge, and said first side plate is provided both at the upper and the lower edges of said recess with through openings for outwardly bent portions of said latch, an upper, outwardly bent end portion of said latch co-acting with a spring of said latch, while a lower, outwardly bent end portion of said latch co-acts with said operating means for moving said latch out of locking position against the action of said spring of said latch whereby said latch in released position lies adjacent that side pocket defined by said first side plate.

2. A buckle as claimed in claim 1, wherein the spring of the latch, which preferably is a compression coil spring, is interposed between the upper end portion of the latch and the first side plate.

3. A buckle as claimed in claim 1, wherein the upper, outwardly bent end portion of the latch is adapted to bear against the lower edge of the upper through opening formed in the first side plate.

4. A buckle as claimed in claim 1, wherein the operating means is a key which is movably arranged between the first side plate and the lower, outwardly bent end portion of the latch, said key being provided with a push button.

* * * * *